340-566
4/22/86 OR 4,584,569

United States Patent [19]

Lopez et al.

[11] Patent Number: 4,584,569

[45] Date of Patent: Apr. 22, 1986

[54] MOTION SENSITIVE SECURITY SYSTEM

[76] Inventors: Michael J. Lopez, 970 Calle Venado, Anaheim, Calif. 92807; Howard A. Williams, Jr., 2629 X. Griset Pl., Santa Ana, Calif. 92704; Henry J. Salvatori, 10633 Virginia Ave., Whittier, Calif. 90603

[21] Appl. No.: 650,835

[22] Filed: Sep. 17, 1984

Related U.S. Application Data

[63] Continuation-in-part of Ser. No. 324,170, Nov. 23, 1981, abandoned.

[51] Int. Cl.[4] ..... G08B 21/00

[52] U.S. Cl. ..... 340/566; 73/650; 73/654; 340/65; 340/571

[58] Field of Search ..... 340/566, 65, 571; 73/654, 650, 658

[56] References Cited

U.S. PATENT DOCUMENTS 4,180,811 12/1979 Yoshimura et al. ..... 340/566
4,234,876 11/1980 Murai ..... 340/566
4,418,337 11/1983 Bader ..... 340/566

*Primary Examiner*—Glen R. Swann, III
*Attorney, Agent, or Firm*—Grover A. Frater

[57] ABSTRACT

The preferred arrangement utilizes a magnet suspended at the center of an elastic cord over a pickup coil. Movement of the magnet is sensed by the coil in that signals are generated by such movement. The signals are processed in the combination of a time delay circuit and a comparator to provide an output which is a measure of acceleration of the element on which the elastic cord is mounted and, in one form, by a measure of jerk in a similar time delay circuit and comparator combination.

22 Claims, 6 Drawing Figures

FIG. 1
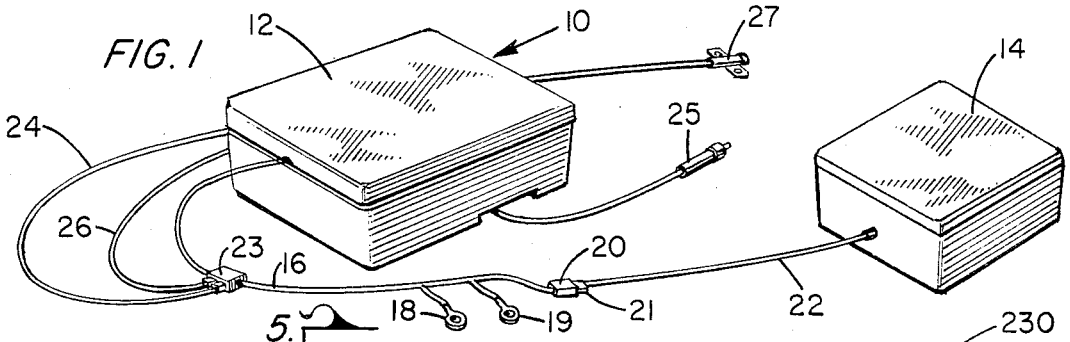
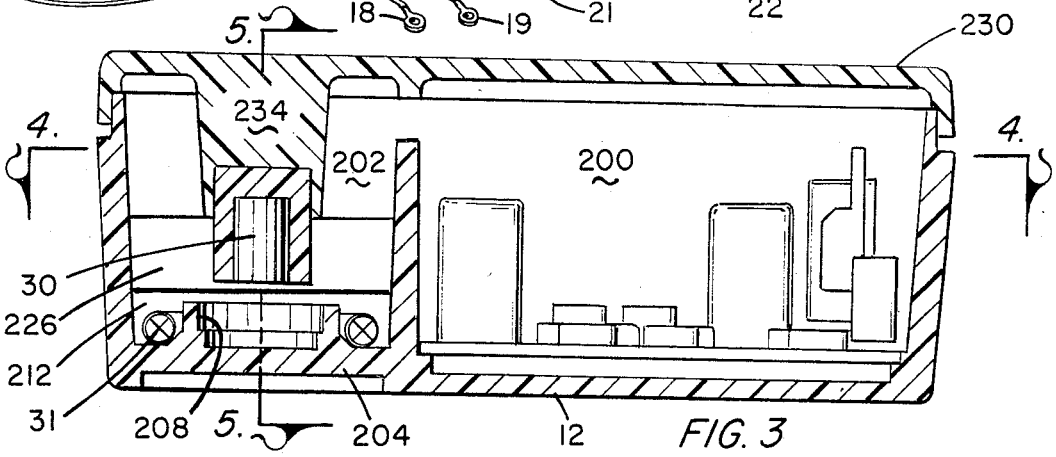
FIG. 3
FIG. 4
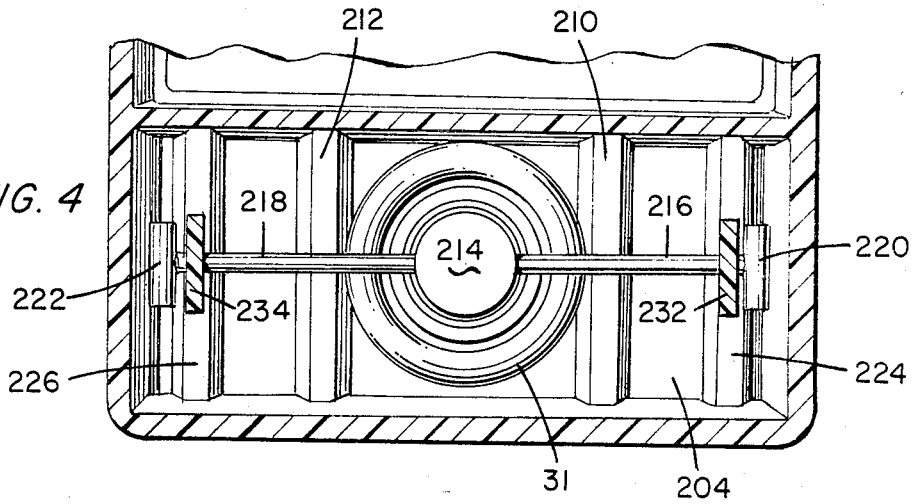
FIG. 5
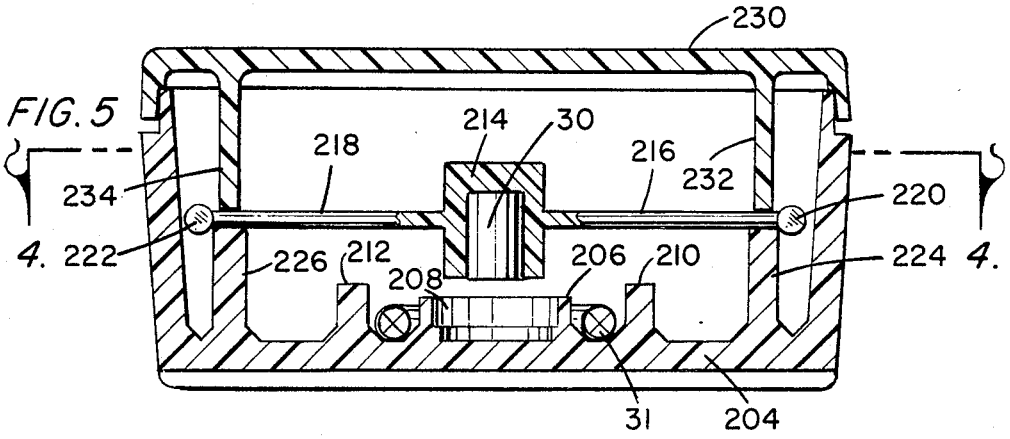

MOTION SENSITIVE SECURITY SYSTEM

CROSS-REFERENCE TO RELATED APPLICATION

This application is a continuaion-in-part of application Ser. No. 06/324,170, filed Nov. 23, 1981, now abandoned.

TECHNICAL FIELD

This invention relates to security systems generally and to improved motion sensors and improved signal processors for such systems.

BACKGROUND ART

This invention is particularly useful for the antitheft protection of motor vehicle, construction equipment, and other high value apparatus in which a security system can be housed. While not limited thereto the invention is particularly useful for the protection of apparatus which is normally moved from place to place or is fixed to an immovable structure. If the apparatus to be protected against theft cannot be made secure by enclosure or attachment, it is usual practice to attempt to sense the theft or attempted theft and, on that occasion, to initiate some preventive measure. A common preventative is to sound an alarm capable of attracting attention to the theft. The detection of motion is a logical choice when attempting to provide an apparatus which is applicable to the protection of a wide variety of portable apparatus in a multitude of different situations. However, designing a satisfactory motion sensitive security system is complicated by the need to differentiate between authorized and unauthorized movement. There is a need to provide operating power in a way that prevents defeat of the system and, in a truly universal system, there is a need to devise a sensor which is effective without regard to spacial orientation or temperature differences and other physical factors.

Prior systems have incorporated features to overcome these and other problems for particular applications. Arming switches, self contained power sources, time delay circuitry, and other means have been employed. In general, however, the inclusion of such features to solve a problem peculiar to one application has rendered the system less useful, or even useless, in other applications. The need remains for a sensor and a system which has wide application, and one purpose of the invention is to satisfy that need.

SUMMARY OF INVENTION

It is an object of this invention to provide an improved motion sensor suitable for sensing motions associated with theft of apparatus. Another object is to provide an improved motion signal processor for security systems. A further object is to provide a security system capable of being arranged to sense motion in intervals in which motion is not authorized and to ignore motion when motion is authorized, is operative without regard to spacial orientation of the sensor, which can be made responsive selectively to motion in any direction, or to a specific motion, which can be used in either a permanent or temporary installation mode, and which has other features directed toward universality.

These and other objects and advantages of the invention which will be made apparent in the description that follows are realized, in part, because of the improved sensor of the invention and, in part, because of its improved signal processor. In preferred form, the sensor comprises a coil adjacent to which a magnet is suspended such that the magnet is freely moved toward and away from the coil, from side to side of the coil in a plane over the coil, and rotationally on an axis which lies in a plane parallel to the coil. The suspension element is a resilient member lying, when relaxed, in a plane parallel to the plane of the coil windings, and, in the preferred form, substantially in the plane containing the center of gravity of the magnet and its mounting structure.

The coil is part of the signal processor. Signals induced in the coil are applied to a band pass amplifier, in the preferred embodiment, whose output is compared in a comparator to a selected standard. Provision is made for altering the standard with a signal such, for example, as might be applied by a switch sensitive to the state of some condition. The comparator output is integrated and is made, at a selected, accumulated signal value, to make energy available for signalling that unauthorized motion has been detected. A timing means terminates the unauthorized motion signal some predetermined time after the integrated signal level falls below a threshold value. Another timer delays integrator operation for a selected time following activation of the system.

The interaction between the several timing circuits, four in the preferred embodiment, is special as is the relation between the timing system and the sensor.

A means is included in the invention for rendering this system inactive for a selected time primarily to avoid sensing motion as an incident to activating the system. In the preferred form that means is proximity sensitive and unauthorized motion is announced by an audible alarm. To make it convenient and effective to use an automotive horn as the sounder, the signal processor includes a means for interrupting horn operation at a frequency in the audible range or below.

The "motion" detecting means in one preferred form of the invention is capable of sensing either or both of acceleration or jerk. Also, that preferred form employs simplified circuitry for arming and disarming the system.

BRIEF DESCRIPTION OF THE DRAWINGS

In the drawings:

FIG. 1 is a perspective view of a system which incorporates the preferred form of the invention;

FIG. 3 is a cross-sectional view, partly schematic, of the sensing and signal processing unit of the system taken on the vertical center plane of the unit;

FIG. 4 is a cross-sectional view of the sensor section of the sensor and signal processing unit taken on line 4—4 of FIG. 3;

FIG. 5 is a cross-sectional view taken on line 5—5 of FIG. 3; and

DESCRIPTION OF THE PREFERRED EMBODIMENT

Figure 2:
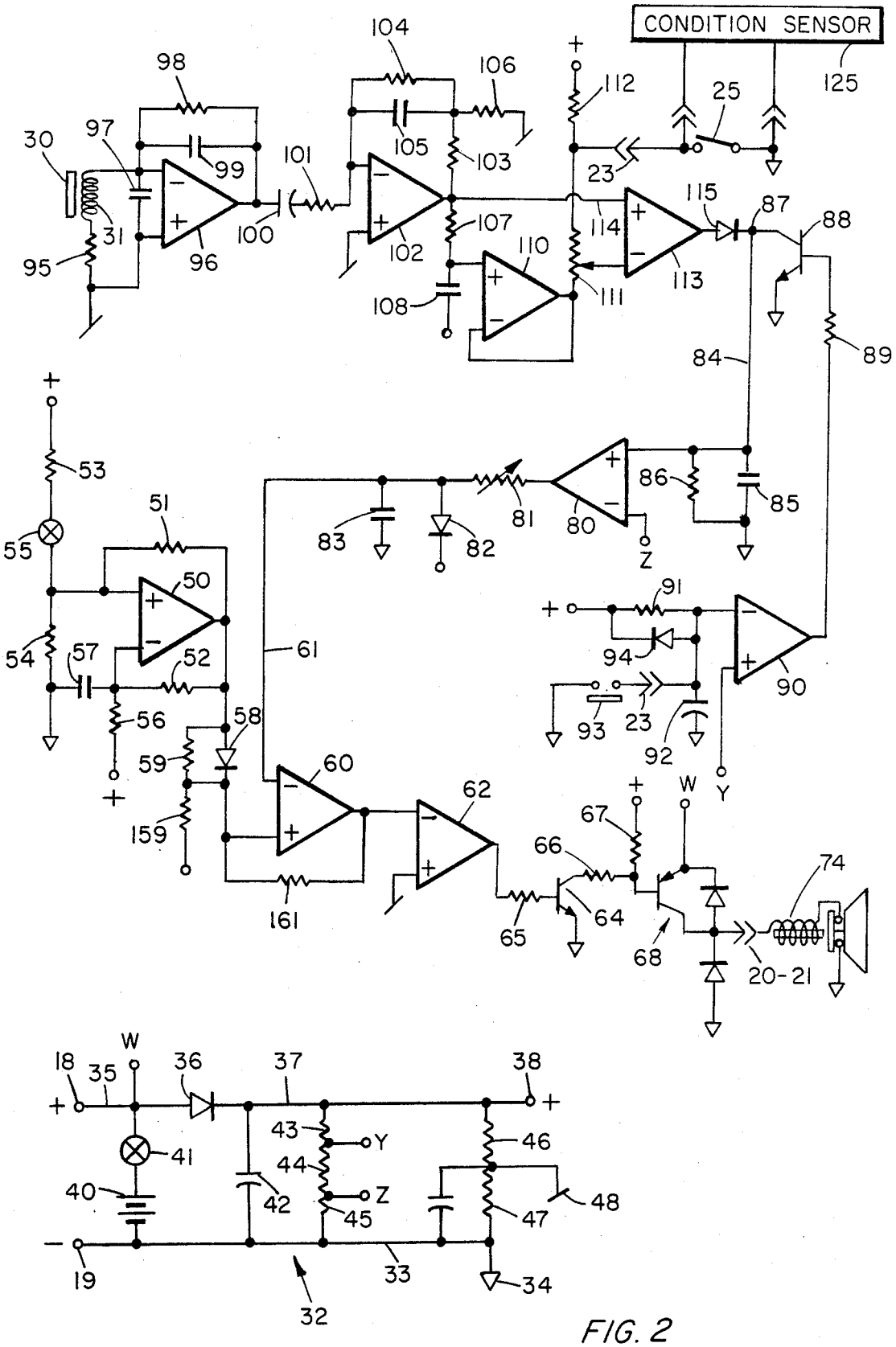
FIG. 2 is a circuit diagram of the sensor and signal processing section of the system of FIG. 1.

The system shown in FIG. 1 of the drawing is generally designated 10. It includes an inclosure 12 which houses a sensor and signal processing electronics and is called the "sensing and signal processing unit." In addition, the system comprises a wiring harness generally designated 16. It extends from the unit 12 and includes connector terminals 18 and 19 for connection to a battery or other source of electrical power. The harness also includes two multiple connector jacks. One of those jacks is numbered 20 and it is interconnected with the plug 21 of a cable 22 that extends to the speaker unit 14. Two plugs are fitted into the other jack 23. One of those plugs is connected by a cable 24 to a spring opened plunger operated switch 25 in parallel with a condition sensor 125. The other plug is connected by a cable 26 to a reed switch 27.

The preferred embodiment includes these several connectors and jacks and plugs so that the system may be readily reconfigured for different applications. If the system is to be permanently installed in an automobile it may be preferred to omit the loud speaker unit 14 and to use the automobile's horn instead. In addition, it may be preferred to omit the battery that is housed in enclosure 12 and instead derive power from the automobile's battery through terminals 18 and 19. The primary sensor utilizes a resilient member and mass combination but, in some cases, particularly in cases of automobiles, it may be desirable to use a mechanically acutated switch to detect some kinds of unauthorized action such, for example, as opening of the automobile's hood or of the automobile's door. That kind of unauthorized action is readily sensed by the plunger switch 25, but a switch of that kind may be unnecessary, and would be omitted, in other situations such, for example, as when the system is attached temporarily to a piece of road building equipment which is to be left on the job site overnight. For an application of that kind it is more convenient to use the internal battery as the power source rather than to attempt to connect the system to the power source of the system of the unit to be protected. Also, in that application the use of the plunger operated motion sensor may be undesirable.

In some applications it is desirable to provide a means for disarming the system at a position known only to the authorized person or persons. In some applications of the system the inclusion of such a switch is desirable. In other applications it might not be needed.

The primary sensor and the signal processing circuitry are packaged so that they can be mounted together at any convenient place within the apparatus to be protected. The sensor responds to acceleration and it is arranged so that it will respond to acceleration in any direction. The sensing apparatus is constructed so that it will sense any acceleration from a very low value to a very large value. The sensitivity of the system is controlled in the signal processing unit and is adjustable to fit the practical circumstance surrounding the application of the system.

Not only will the sensor sense motion in any direction but its response to acceleration is relatively independent of the spacial orientation of the unit 12. That feature is particularly important when the system is moved from one security test to another. Even when it is not as, for example, when permanently mounted in a motor vehicle, the fact that the sensor is omnidirectional permits a wider choice of mounting arrangements.

The preferred form of sensor employs a mass resilient member spring arrangement in which movement of the mass causes movement of a magnet in proximity to a pick-up coil. The coil is located in the field of the magnet which ordinarily forms at least part of the mass so that a voltage is induced in the coil as a consequence of movement of the mass. The value of the mass and the stiffness of the resilient member are selected so that the magnet will be moved in significant degree in response to even very small values of motion. A popular term for such an apparatus is "motion detector." In FIG. 2 the magnet is identified with the reference numeral 30, and the coil is numbered 31.

Signal Processing Circuit

The signal processor of preferred form employs integrated circuit devices that require energization from sources that are both more positive and more negative than intermediate or reference potential. That requirement is met by the power supply circuitry shown in the lower left corner of FIG. 2. The power supply, which is generally designated 32, includes terminals 18 and 19. They are arranged for connection through a main power switch to an external battery the positive side of which is connected to terminal 18 and the negative side of which is connected to terminal 19. Terminal 19 is connected by line 33 to system ground identified by the symbol marked 34. The positive terminal 18 is connected by line 35 to a supply terminal W and to a rectifier 36 the other side of which is connected by line 37 to the positive terminal 38 of the signal processor circuitry. The internal power source is a battery 40 which is connected in series with a switch 41 between lines 35 and 33. Transients in this system are filtered out by a capacitor 42 which is connected between lines 37 and 33. Resistors 43, 44 and 45 are connected in series, in that order, between line 37 and line 33. A power terminal Y is connected to the juncture of resistors 43 and 44, and a power terminal Z is connected to the junction between resistors 44 and 45. A second voltage divider is formed by resistors 46 and 47 which are connected in series, in that order, between lines 37 and 33. The juncture of resistors 46 and 47 is connected to the reference voltage terminal which is numbered 48.

Just above the power circuit 32 of FIG. 2 is an audio oscillator. It includes a comparator 50 whose output is connected by resistor 51 to its positive input and by resistor 52 to its negative input. The positive input of the comparator is connected to the junction of resistors 53 and 54 which are connected to form a voltage divider between the positive line and negative ground. That voltage divider circuit includes a switch 55 which is opened to disable the oscillator when, for example, the speaker or alarm device includes its own modulator or is not to be modulated.

The negative input of the comparator 50 is connected to the juncture of a resistor 56 and a capacitor 57 which are connected in series from the positive line to ground and together form the frequency control circuit of the oscillator.

The output of the comparator 50 is applied through the parallel combination of diode 58 and resistor 59 to the positive input of a comparator 60 and to the positive line through another resistor 159. A resistor 161 connects the output of the comparator with the positive input. The negative input is connected by a line 61 to a control circuit to be described below. The output of the comparator is also connected to the negative input of a comparator 62 whose positive terminal is connected to the reference line. The output of the latter is connected to the base of a transistor 64 through a resistor 65. The emitter of the transistor is connected to ground voltage and the collector is connected by resistors 66 and 67, in series, to the positive line. The junction of resistor 66 and resistor 67 is connected to the base of a power transistor 68 whose emitter is connected to the power terminal W and whose collector is connected through the jack and plug set 20-21 to the output sounding device 74. A pair of diodes, one connected across the emitter and collector of transistor 68 and the other connected from its collector to circuit ground, protect the transistor.

The oscillator and amplifier are operative only when the output of comparator 80 is applied through the adjustable resistor 81 to line 61 to apply a positive signal to the negative input terminal of the comparator 60. A diode 82 is connected between line 61 and the positive terminal, and the capacitor 83 is connected between line 61 and circuit ground.

The negative input of comparator 80 is connected to the power terminal Z between resistors 44 and 45 of the power circuit 32. The positive input of comparator 80 is connected to line 84. A timing circuit formed by the parallel combination of a capacitor 85 and a resistor 86 are connected between line 84 and ground. Line 84 extends to a junction 87. That junction is connected to the collector of a transistor 88 whose emitter is connected to circuit ground and whose base is connected through a resistor 89 to the output of a comparator 90 whose positive terminal is connected to the power terminal Y between resistors 43 and 44 of the first described voltage divider network in power circuit 32. The negative terminal of comparator 90 is connected to the junction of resistor 91 and capacitor 92 which are connected in series, in that order, between the positive line and ground. The resistor and capacitor form a timing circuit. Provision is made for rendering that circuit inoperative by shorting the capacitor. The shorting circuit is formed in parallel with the capacitor and it includes the normally open reed switch 93 and the connector 23 of the wiring harness.

At the upper left in FIG. 2 coil 31 is disposed within the magnetic field of magnet 30. The coil is connected in series with a resistor 95 between the negative input terminal and the positive input terminal of an amplifier 96. The positive terminal of the circuit is connected to the reference potential line of the system, and a capacitor 97 is connected in parallel with the combination of coil 31 and resistor 95. The output of the amplifier 96 is connected by the parallel combination of a resistor 98 and a capacitor 99 to the negative input terminal of amplifier 96. In addition, the output of amplifier 96 is connected through a coupling capacitor 100 and a series resistor 101 to the negative input terminal of an amplifier 102 whose positive input is connected to the reference potential line. The output of amplifier 102 is connected by the series combination of a resistor 103 and a parallel circuit consisting of resistor 104 and capacitor 105 to the negative input terminal of the amplifier 102. The junction between the resistor 103 and the parallel circuit is connected by a resistor 106 to the reference potential line. In addition, the output of amplifier 102 is connected to one end of a series circuit formed by resistor 107 and capacitor 108 between the output of amplifier 102 and the reference potential line, in that order. The junction between resistor 107 and capacitor 108 is connected to the positive input terminal of amplifier 110 whose negative input terminal is connected to the output of that amplifier. The output is also connected through the series combination of a potentiometer 111 and a fixed resistor 112 to the positive line. The junction between the potentiometer and the fixed resistor is connected through the jack and plug set 23 to one side of the normally open plunger switch 25 whose other side is connected to circuit ground. The tap of the potentiometer is connected to the negative input of another comparator 113 whose positive input terminal is connected by line 114 to the output of amplifier 102. The output of comparator 113 is connected through a diode 115 to the junction point 87.

Diode type 1N4001 may be used everywhere where a diode is indicated in the diagram. The several amplifiers and comparators in the circuit are integrated circuit type 324. Appropriate values for the other elements of the circuit are listed in the chart below.

Component Values

| | Value |
|---|---|
| Resistors | |
| 43, 45, 47, 89, 107, 112 | 27K ohms |
| 44, 59, 101, 81 | 100K ohms |
| 106 | 1K ohms |
| 56, 104 | 1 Meg ohms |
| 46, 51, 52, 53, 54, 67, 98, 103, 111, 112 | 10K ohms |
| 86, 91 | 470K ohms |
| Capacitors | |
| 42, 97, 99, 105, 108 | 0.1 mfd |
| 57, 83, 85, 92, 100 | 100 mfd |

Operation of the Circuit

The sounder 74 is energized when transistor 68 is turned on. The horn circuit includes a make-and-break switch so that the horn will sound notwithstanding that it is energized from the unidirectional source. Transistor 68 is turned on by the output of current amplifier 62 when comparator 60 is rendered conductive. The comparator 60 is turned on when the voltage across capacitor 83, which is applied to the negative terminal of comparator 60 by line 61, exceeds the potential at the positive input of comparator 60. The potential at the positive terminal is established by the resistive network formed by resistors 56, 52, 59, 159 and 161, and the voltage that is applied to that network from the positive side of the power source, and the output of the comparator 50 which is connected as a multivibrator.

In summary, the sounder 74 will be turned on and off at a rate determined by the multivitrator when the potential across capacitor 83 exceeds some threshold value. Capacitor 83 is charged by comparator 80 through the variable resistor 81 at a rate that is determined by the output potential of the comparator and the value of the resistor. Comparator 80 is turned on to charge the capacitor 83 only when the potential at its positive input exceeds the reference potential Z which is applied to its negative input. The potential at the positive input is equal to the potential across capacitor 85. A discharge resistor 86 is connected in parallel with capacitor 85 to form a timing circuit. A means is incorporated in this system for preventing the accumulation of charge on capacitor 85, or for rapidly discharging the capacitor, and in this preferred embodiment that means comprises the transistor 88 whose collector/emitter circuit is connected in parallel with the capacitor. When that transistor is rendered conductive the capacitor is shorted to ground. Conduction is controlled by comparator 90 whose output is applied to the base of transistor 88. The comparator has its positive input connected to a reference source of positive potential. The negative input is connected to a timing circuit formed by the series combination of resistor 91 and capacitor 92. The output of the comparator 90 will turn the transistor 88 on until the capacitor 92 charges through resistor 91 to a value that exceeds the potential at the positive input of the comparator. As a consequence of that, transistor 88 is turned on and the capacitor 85 is prevented from being charged for an interval following application of power to the circuit until the capacitor 92 has been charged. Closure of the reed switch 93 will discharge capacitor 92 and result in a turn on of comparator 90 to turn on the transistor 88 and prevent capacitor 85 from being charged until the switch 93 is reopened and the capacitor 92 has been charged through resistor 91.

Capacitor 85 is charged by output current from comparator 113 through diode 115 as an incident to detection of motion at coil 31. Motion of the magnet induces a voltage in coil 31 and that voltage is applied across the positive and negative inputs of amplifier 96. The output of amplifier 96 is applied to the input of amplifier 102. The function of the several resistors and capacitors that are associated with amplifiers 96 and 102 is to limit the frequency response of the system to values that correspond to the frequency of voltage variations induced in coil 31 for the kind of motion and acceleration to be detected. In practice, and in this preferred embodiment, the amplifier 102 will provide an output in response to changing input at frequencies below about ten kilo-Hertz. For practical reasons, the circuit is made responsive to frequencies in the range between about eight cycles per second and 160 cycles per second. The output of amplifier 102 is applied directly to the positive input of comparator 113 and is applied to the negative input of that comparator through the combination of current amplifier 110 and a time delay circuit formed by resistor 107 and capacitor 108. Use of the delay circuit results in compensation for any offset in the output of amplifier 102. In the absence of motion the output of amplifier 102 does not change and equal potentials are applied to the inputs of comparator 113. When the output of amplifier 102 is changed the delay in applying the change to the negative terminal will result in input differences that turn on the comparator 113 and result in the charging of capacitor 85.

Summarizing the operation of the system, acceleration is detected by the combination of magnet 30 and coil 31, and results in the charging of capacitor 85. That capacitor having been charged, comparator 80 will apply an output through resistor 81 to capacitor 83. After some time interval, the duration of which can be adjusted by adjustment of the value of resistor 81, capacitor 83 will be charged above a threshold value and will result in comparator 60 and the horn 74 being turned on.

There are applications for the system in which it is desired that the alarm be sounded in response to activity that is most easily sensed with a switch, current sensor or a sensor of some other condition related to a violation of security. Thus, for example, it may be desirable to sound the alarm if the vehicle door or hood or trunk lid is opened whether or not that motion is sensed by the acceleration sensor. The preferred system includes such a switch, numbered 25 in FIG. 1 and connected between ground and the junction between resistors 111 and 112 in FIG. 2. If switch 25 is closed the output of comparator 113 will go high. Capacitor 85, and thus capacitor 83, will become charged and the horn will operate as previously described. A condition sensor 125 in this case a circuit whose output goes low when ignition current flows, is connected in parallel with switch 25.

The system is enabled or disabled by interrupting the power source. The means for interrupting energy from an external power source is not shown in the diagram. The switch 41 is used for interrupting energy supply when the source is internal. When the sensing and signal processing unit is mounted in a relatively inaccessible place the switch 41 would be mounted at a place more conveniently accessible.

There are two ways to disable the unit. One is to open the power supply circuit, and the other is to close the reed switch 93. In preferred form the reed switch is magnetically actuated and is used when it is desired to disable the system for a short period of time. The system is disabled immediately when the switch 93 is closed because closure discharges capacitor 92 and results in the immediate discharge of capacitor 85. Resetting is delayed until capacitor 92 is recharged above the threshold level through resistor 91. The time that the horn continues to be activated following the cessation of motion is determined primarily by the discharge rate of capacitor 85, and that is determined by the combination of the amount of its capacitance and the resistance of resistor 86.

The interrelationship of the several timing circuits to one another and to the motion detector is special. The motion detector has a natural oscillation frequency in each of its several movement modes which lies within the passband of the circuit between coil 31 and capacitor 85. Acceleration or other motion once detected results in oscillation of the magnet (or coil if it is the coil that is resiliently mounted) to provide a signal which continues for some period even if acceleration is limited to a very short interval.

Capacitor 85 of the third timing circuit is charged rapidly once the comparator 113 begins conducting current but only if transistor 88 is turned off. The transistor serves as a short circuit around capacitor 85 until capacitor 92 of the first timing circuit is charged. It begins charging when the system is powered and it charges slowly through resistor 91. Thus, while the sensor and its circuitry are immediately available to charge capacitor 85, charging is delayed to permit powering and enabling the system without sounding the alarm.

While it is charged rapidly from comparator 113, capacitor 85 discharges slowly through resistor 86. As a consequence comparator 80 supplies charging current to capacitor 83 of the second timing circuit over a relatively long period. Capacitor 83 discharges through a different circuit over a longer period. That arrangement of timing circuits insures that system operation is substantially the same in response to actuation of the specific motion detection switch 25 as to acceleration of magnet 30. It permits setting alarm time at resistor 81 independently of system sensitivity which is set at resistor 111, and it delays turn off if the alarm is on when the switch 93 is closed. That latter feature is important because the thief who has set off the alarm and finds switch 93 in his attempt to silence the alarm cannot tell by its actuation that he has found the disabling switch.

The Motion Detector

The motion or acceleration detector is formed by the combination of a magnet and a coil arranged so that relative motion between them results in induction of a potential in the coil. In the preferred embodiment the coil 31 is fixed and the magnet 30 is suspended over it by an elongated resilient member which extends in a plane perpendicular to the plane containing the coil and magnet. In the preferred form the magnet is made cylindrical and is mounted so that the axis of the cylinder is substantially coincident with the axis of the coil. The coil is round and its inside diameter is greater than the diameter of the cylinder. The magnet is suspended so that the magnet face toward the coil does not extend into the coil, and it is mounted in the enclosure so that a majority of the flux lines extending from one end of the magnet to the other are confined within the enclosure and will be unaffected by magnetic structure which are external to the housing such, for example, as magnetic structures on which the housing might be mounted. That arrangement ensures that a substantial number of flux lines will be cut by the pick-up coil 31 as an incident to even small motion of the magnet in any direction. As a consequence, a voltage will be developed in the pick-up coil if the magnet is moved in the direction of its axis toward or away from the coil. A voltage will be generated in the pick-up coil if the magnet is moved so that its axis is displaced in any direction from the axis of the coil, and a voltage will be generated in the coil if the magnet is moved so that its axis is tilted with respect to the axis of the coil. The magnet is suspended by a resilient member in a way that ensures that a number of these possible motions will occur in the event that there is any movement of the magnet relative to the coil. As best shown in FIGS. 4 and 5, the magnet in the preferred embodiment is mounted at a mid-region along the length of an elastic cord which is stretched across the sensor cavity of the housing its ends held in place by clamps which are integrally formed with the housing.

The enclosure 12 is divided into two compartments. One is designated 200 and is the compartment which contains the signal processing electronics and, in some versions of the preferred embodiment, the horn and the power supply battery. The other compartment is identified by the reference numeral 202 and it is the one that contains the sensor. The lower wall of the sensor compartment 202 is numbered 204. Conformations on the inner side of that lower wall define an annular inwardly projecting wall 206 whose axis is perpendicular to the plane of the wall 204.

The coil 31 surrounds that annular wall. Two ribs 210 and 212, respectively, extend across the sensor cavity one on each side of coil 31. Those ribs are integrally formed on the inner surface of the bottom wall.

Together those several conformations protect the coil against being struck by the magnet structure and damp excessive movement of the magnet without limiting the generation of signal voltages.

In this preferred embodiment magnet 30 is lodged in a cylindrical cup 214 which embraces the magnet except at one face, the lower face in FIGS. 3 and 5. The cup 214 is integrally formed with the suspension members which extend from diametric points on the cup wall substantially in the plane of the center of gravity of the magnet and cup assembly. The suspension members are numbered 216 and 218, respectively. They are substantially alike in length and in diameter and in every other characteristic, and each terminates in an enlargement or keeper which, in this form, is substantially cylindrical. The cylindrical end of the arm 216 is numbered 220, and the cylindrical end of the arm 218 is numbered 222. Each arm, adjacent its respective cylindrical end, resides in a notch formed in the upper face of a crossmember that extends across the interior of the sensor section of the housing parallel to the ribs 210 and 212. The rib associated with arm 216 is numbered 224 and the rib associated with arm 218 is numbered 226. Fingers formed on the inner wall of the cover 230 extend downwardly toward ribs 224 and 226, respectively. The finger 232 extends down into engagement with the upper surface of rib 224 on the opposite sides of the notch in which arm 216 is disposed, and at the other side finger 234 extends down and engages the upper surface of rib 226 on opposite sides of the notch in which arm 218 is disposed. In this preferred embodiment each of the arms is twisted three turns each in opposite directions at the time of assembly. The arms are held in place in notches so that they do not become untwisted in the assembly process.

The dimensions of the resilient arms and the weight of the magnet are not critical. However, the natural resonant frequency of the mass and resilient member combination should lie in passband of the signal processer, in this particular case between ten and 150 cycles per second in any orientation of the housing. Beyond that it is only required that the magnet remain suspended in any orientation so that it is free to move from side to side and to rotate about the axis of the arms and to move in the direction of the axis of the coil.

Alternative Signal Processing Unit

Large trucks are attractive objects for thieves not only because of the value of the truck but especially because of the value of their cargos. Protecting them is more difficult than protecting smaller vehicles because many truck designs afford easier access to the engine compartment and electrical system, especially from below. Certain features of the invention, while having general application, are especially useful in the case of large trucks. One of those features is the ability to detect heavy, short time application of forces by detecing jerk as distinguished from acceleration. Forces resulting in acceleration of portions of a vehicle occur in normal use so it is necessary to incorporate delays in security apparatus to permit deactivation of the system for normal use. Those time delays present opportunity for thieves who understand the construction and operation of the system. But long time delays are not required in the case of jerk, and response to jerk removes the possibility of disabling the security system with sharp, impacting blows.

Other improvements and functions are provided in the preferred form of the invention for certain applications. Some of them relate to alternative means for developing input signals to which the system is to respond, and one relates to an alternative arrangement for disabling the system.

Figure 6:
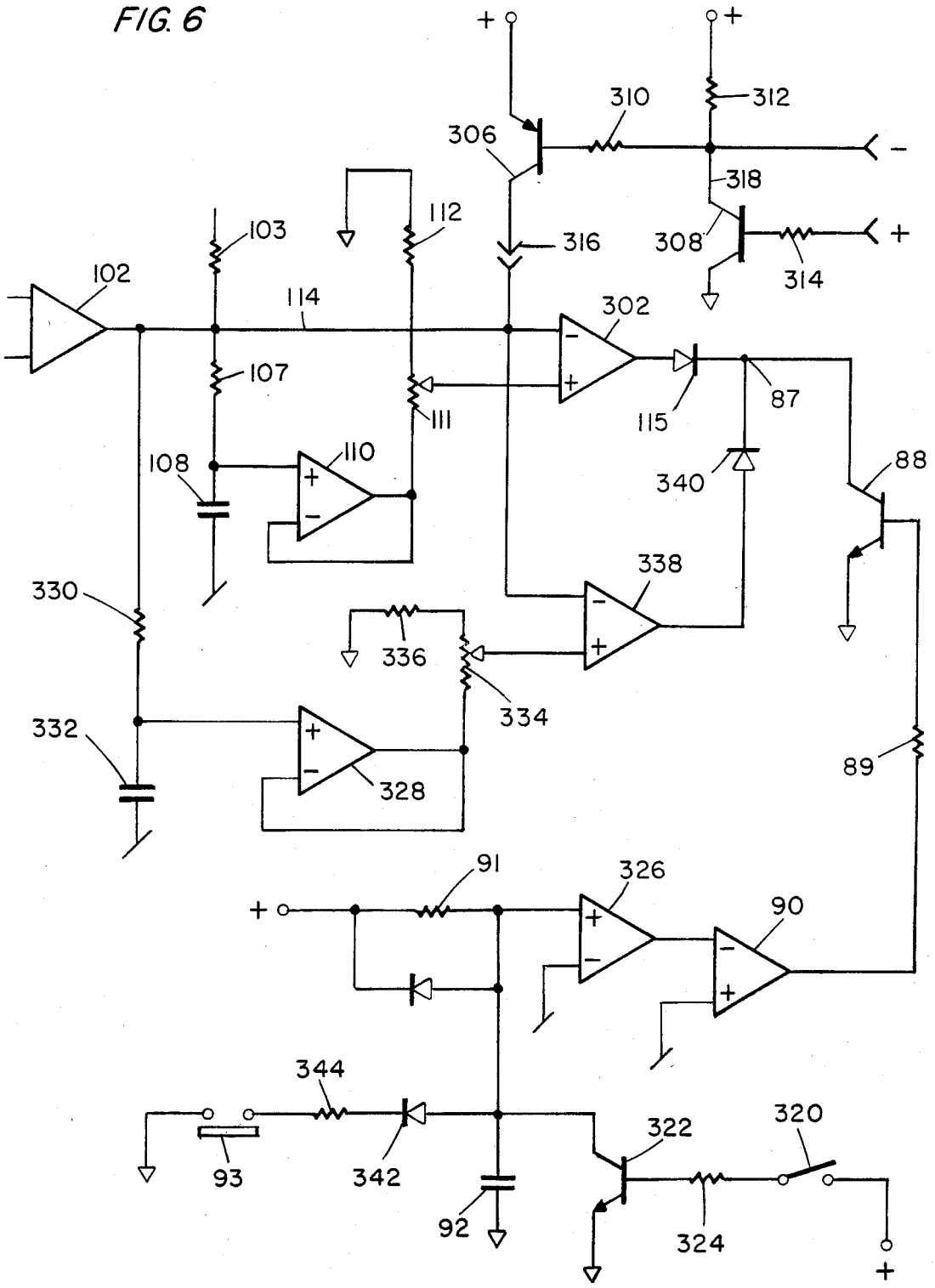
FIG. 6 is a diagram showing a portion of the circuit of FIG. 2 in an alternate, preferred form.

The circuit of FIG. 6 illustrates how these added functions and features are achieved by modification of FIG. 2. Only so much of FIG. 2 is incorporated in FIG. 6 as is deemed necessary to illustrate where the changes and additions are to be made in FIG. 2. Reference numerals below 200 in FIG. 6 identify elements found in FIG. 2. Added elements are identified by reference numerals greater than 300.

In FIG. 2 differential amplifiers 102 and 110 detect motion by measuring a function of acceleration which continues for a period which is compared to the timing circuit formed primarily by resistor 107 and capacitor 108, and has an amplitude which is compared to the voltage level set by potentiometer 111. The acceleration measuring elements of FIG. 6 are the same except that the input connections to the amplitude measuring comparator are reversed. Amplifier 302 of FIG. 6 is like comparator 113 of FIG. 2 except for reversal of input connections. Reversal of the comparator connections requires a change in reference potential because the polarity of the output to diode 115 and junction 87 is to remain the same. The change is accomplished by adjusting potentiometer 111 to change the polarity of the relative difference between input terminals without significant change in the magnitude of difference.

Reversal of comparator inputs simplifies the application of inputs from other external condition sensors. The condition sensor 125 and switch 24 and connector 23, all of which are found in FIG. 2, are replaced in FIG. 6 by transistors 306 and 308, current limiting resistors 310, 312 and 314 and a circuit interconnector 316. One side of the latter is connected to line 114 and the negative input of comparator 302. The other side of the circuit connector is connected to the collector of a transistor 306 whose emitter connects to positive d.c. power potential. The base of PNP transistor 306 is connected through resistor 310 to negative initiating signal line 318. A resistor 312 is connected between line 318 and positive d.c. power potential. The NPN transistor 308 has its emitter connected to the negative side of the d.c. supply and its collector connected to line 318.

In the absence of a negative potential on line 318 or of a positive potential at the base of transistor 308, the base of transistor 306 is positive because there is minimal voltage drop across the resistors 312 and 310. In that case, transistor 306 is turned off and no unbalancing potential is applied by transistor 306 to line 114 and comparator 302. However, if line 114 is made negative by a sensor or switch or the like, either directly or indirectly by turning on transistor 308 with a positive potential at its base, the transistor 306 will be turned on to unbalance comparator 302 and apply a signal to junction point 87. The response of the apparatus to such a signal has already been explained in the description of FIG. 2.

In FIG. 2 the combination of resistor 91 and capacitor 92 acting through comparator 90 and NPN transistor 88 delays enablement of the alarm system for a short time after opening of the reed switch 93.

Using a magnet which is carried on a key ring, a vehicle driver may close the hidden reed switch to discharge capacitor 92 whereby the alarm system is disabled until the capacitor is recharged. In FIG. 6 that portion of the circuit is modified to utilize a set of contacts which form a switch 320, as part of the ignition switch unit, to short circuit the capacitor 92 whenever the vehicle ignition switch is in the "on" position. A diode 342 and a limiting or timing resistor 344 have been added in series with the reed switch 93. The circuit of FIG. 6 assumes that potential at the ignition switch is positive, which is almost universal. That potential is applied by switch 320 to the base of NPN transistor 322 through a limiting resistor 324. The transistor's emitter is connected to system negative as is one side of capacitor 92. The transistor's collector is connected to the other side of the capacitor. The voltage levels at which system activation is achieved is altered to accommodate the transistor characteristics by adding a comparator 326 between the junction of resistor 91 and capacitor 92 on one side and the negative input of comparator 90 on the other. The input terminals of comparator 326 are reversed so the junction between timing resistor 91 and capacitor 92 is connected to the comparator's positive input.

In certain cases it is desirable to have the security system provide an output to a sounder or otherwise in response to impact, or more accurately, jerk, in addition to the response occasioned by acceleration. To accomplish that result the form of the invention depicted in FIG. 6 includes still another integrator or timer coupled to still another amplitude comparator 328. FIG. 6 includes a resistor 330 and a capacitor 332 connected in series in that order from line 114 at the output of comparator 102 to the neutral point of the power supply. The junction between resistor 330 and capacitor 332 connects to the positive input of a comparator whose other input is connected to its output. That output is connected to one end of potentiometer 334. The circuit extends from the output of comparator 328 through the potentiometer resistor 334 and a dropping resistor 336 to the negative side of the d.c. power supply. The potentiometer slider connects to the positive terminal of a comparator 338 whose negative terminal connects to line 114 at the output of comparator 102. The output of comparator 338 is connected through a diode 340 to junction point 87 of FIGS. 2 and 6.

Thus the circuit formed by elements 330, 332, 328, 334, 336, 338 and 340 has the same configuration and is in parallel with the circuit formed by elements 107, 108, 110, 111, 112, 302 and 115. One provides an output in response to relatively low magnitude acceleration which continues for a relatively long period. The other provides an output in response to relatively high magnitude jerk which continues for a much shorter time. The difference in amplitude response is adjusted by relative adjustment of the potentials at the respective positive terminals of comparators 302 and 338 and that is done by adjustment of potentiometer settings. Measurement of duration is accomplished in resistor and capacitor 107 and 108 in the case of acceleration measurement. In one case resistor 107 has the value 1.0 megohm and capacitor 108, 0.1 mfd. In the jerk circuit, resistor 330 is only 220 K ohms and capacitor 332, 0.1 mfd.

Although we have shown and described certain specific embodiments of our invention, we are fully aware that many modifications thereof are possible. Our invention, therefore, is not to be restricted except insofar as is necessitated by the prior art.

We claim:

1. In a security system:

a motion sensor comprising a magnet and a coil disposed in the field of the magnet, one of the magnet and coil being fixed and the other being moveable relative to the fixed one in the direction toward and away therefrom in a first plane, and being moveable relative to the fixed one in a perpendicular plane perpendicular to said first plane and parallel to the plane containing said fixed one, and being moveable rotatably about an axis extending substantially along the intersection of said first plane and said perpendicular plane.

2. The invention defined in claim 1 which further comprises a signal processing means for sensing voltage variations across said coil and for providing an output signal incident to relative movement of said coil and magnet and for providing an output signal.

3. The invention defined in claim 2 in which said signal processing means includes a delay means effective to prevent provision of said output signal for a time following application of power to said system as a function of time.

4. The invention defined in claim 3 in which said signal processing means further comprises second time delay means effective to prevent provision of said output signal for a period following the sensing of motion by said motion sensor which period is independent of the magnitude of the sensed acceleration for magnitudes greater than a given magnitude.

5. The invention defined in claim 4 in which said signal processing means further comprises a third time delay means effective to continue provision of said output signal, once provided, for not less than a predetermined time period.

6. The invention defined in claim 4 in which each of said time delay means comprises a resistor and capacitor combination and in which the charge on the capacitor is changed;

the charge on the capacitor of the second being changed rapidly, provided that the charge on the capacitor of the third timing means is within a predetermined range of charges, upon the sensing of acceleration and returned toward initial value less rapidly.

7. The invention defined in claim 6 in which the charge on the capacitor of the second time delay means is changed in response to sensing of acceleration only during the interval when the charge on the capacitor of said first time delay means is returned toward its charged value.

8. The invention defined in claim 7 which comprises disabling means discharging the capacitor of the third timing circuit.

9. The invention defined in claim 2 in which said signal processing means comprises a comparator having a pair of input terminals each subjected to respectively associated signals as an incident to voltage variation across said coil, the signal applied to one of said input terminals being delayed relative to the time of application to the other input terminal of its associated signal.

10. The invention defined in claim 9 in which said magnet is suspended in the mid-region along the length of a resilient cord.

11. The invention defined in claim 10 in which said resilient cord comprises a pair of arms extending in opposite directions from said magnet, prestressed in torsion and in tension and each arm being fixed relative to said coil at a respectively associated point.

12. The invention defined in claim 1 in which said magnet is suspended in the mid-region along the length of a resilient cord.

13. The invention defined in claim 12 in which said resilient cord comprises a pair of arms extending in opposite directions from said magnet, prestressed in torsion and each arm being fixed relative to said coil at a respectively associated point.

14. The invention defined in claim 13 in which said coil is generally circular and lies, in a plane parallel to a plane containing said arms;

the magnet being mounted for movement along the axis of the coil exteriorly of the coil.

15. In a security system:

sensing means for providing a motion signal in response to motion imparted to an element of the sensing means;

a signal processing means responsive to said motion signal for providing an output signal;

said signal processing means comprising first, second and third time delay circuits the first time delay circuit being connected to delay operation of the second and third time delay circuits and the second time delay circuit being connected to delay provision of said output signal following receipt by said signal processing means of a motion signal for a period determined only by said second time delay circuit;

said third time delay circuit being connected to continue furnishing of said output signal following termination of the motion signal for a period determined, after completion of the operation of said second time delay circuit, only by said third time delay circuit.

16. The invention defined in claim 15 in which said signal processing means includes a sounder and means for applying said output signal to said sounder intermittently.

17. The invention defined in claim 16 in which said third time delay circuit comprises a third delay circuit capacitor connected to have its charge changed rapidly in response to a sensing signal and returned toward initial value more slowly following cessation of said sensing signal; and in which said second time delay circuit comprises a second delay circuit capacitor whose charge is alter relatively slowly in intervals when the charge on said third delay circuit capacitor differs from initial value by more than a predetermined amount.

18. The invention defined in claim 17 in which the first time delay circuit comprises a first circuit capacitor connected to have its charge changed relatively slowly from an initial value upon the application of power to said signal processing means and connected to prevent alteration of the initial charge on said third circuit capacitor for a period following such application of power.

19. The invention defined in claim 18 which further comprises means in the form of a disabling switch connected to return the charge on said first circuit capacitor rapidly toward the value of charge on said capacitor prior to application of power to said signal processing means.

20. In a security system:

a magnet and a coil disposed in the field of the magnet such that a signal voltage is generated in the coil as an incident to relative movement between the magnet and the coil; and a signal processor capable of sensing voltage variations across the coil and of providing an output singal, means for providing an output signal, said signal processor comprising first output signal providing means for providing an output signal in response to signal voltages greater than a first given magnitude for a period of first duration;

said processor further comprising second output signal providing means for providing an output signal in response to signal voltages greater than a second given magnitude for a period of second duration;

said first and second output signal providing means each comprising a time delay circuit and an associated comparator connected to compare the current amplitude of said signal voltage with its amplitude at a time prior by the amount of said delay.

21. The invention defined in claim 20 in which one of said first and second output signal providing means has a time delay circuit providing a relatively long delay and is arranged to provide an output signal in response to a voltage signal of some minimum amplitude, and in which the other of said first and second output signal providing means has a time delay circuit providing a relatively short delay and is arranged to provide an output signal in response to a voltage signal having amplitude higher than said minimum amplitude.

22. The invention defined in claim 21 further comprises means for filtering from said signal voltage components which vary in amplitude at frequencies outside the range from eight to one hundred and sixty cycles per second.

* * * * *

REEXAMINATION CERTIFICATE (1309th)

United States Patent [19] [11] B1 4,584,569

Lopez et al. [45] Certificate Issued Jun. 19, 1990

[54] MOTION SENSITIVE SECURITY SYSTEM

[76] Inventors: Michael J. Lopez, 970 Calle Venado, Anaheim, Calif. 92807; Howard A. Williams, Jr., 2629 X. Griset Pl., Santa Ana, Calif. 92704; Henry J. Salvatori, 10633 Virginia Ave., Whittier, Calif. 90603

Reexamination Request:
No. 90/001,806, Jul. 10, 1989

Reexamination Certificate for:

| | |
|---|---|
| Patent No.: | **4,584,569** |
| Issued: | **Apr. 22, 1986** |
| Appl. No.: | **650,835** |
| Filed: | **Sep. 17, 1984** |

Related U.S. Application Data

[63] Continuation-in-part of Ser. No. 324,170, Nov. 23, 1981, abandoned.

[51] Int. Cl.[5] ..... G08B 21/00

[52] U.S. Cl. ..... 340/566; 73/650; 73/654; 340/429; 340/571

[58] Field of Search ..... 340/527, 528, 691, 384 E

[56] References Cited

U.S. PATENT DOCUMENTS

| | | | |
|---|---|---|---|
| 2,111,643 | 3/1938 | Salvatori | 310/25 |
| 3,158,831 | 11/1964 | Boyer | 310/329 |
| 3,197,756 | 7/1965 | Maynard | 73/517 |
| 3,995,268 | 11/1976 | Ferrari | 340/384 E |
| 4,122,437 | 10/1978 | Petersen | 340/528 |
| 4,180,811 | 12/1979 | Yoshimura et al. | 340/566 |

*Primary Examiner*—Glen R. Swann, III

[57] ABSTRACT

The preferred arrangement utilizes a magnet suspended at the center of an elastic cord over a pickup coil. Movement of the magnet is sensed by the coil in that signals are generated by such movement. The signals are processed in the combination of a time delay circuit and a comparator to provide an output which is a measure of acceleration of the element on which the elastic cord is mounted and, in one form, by a measure of jerk in a similar time delay circuit and comparator combination.

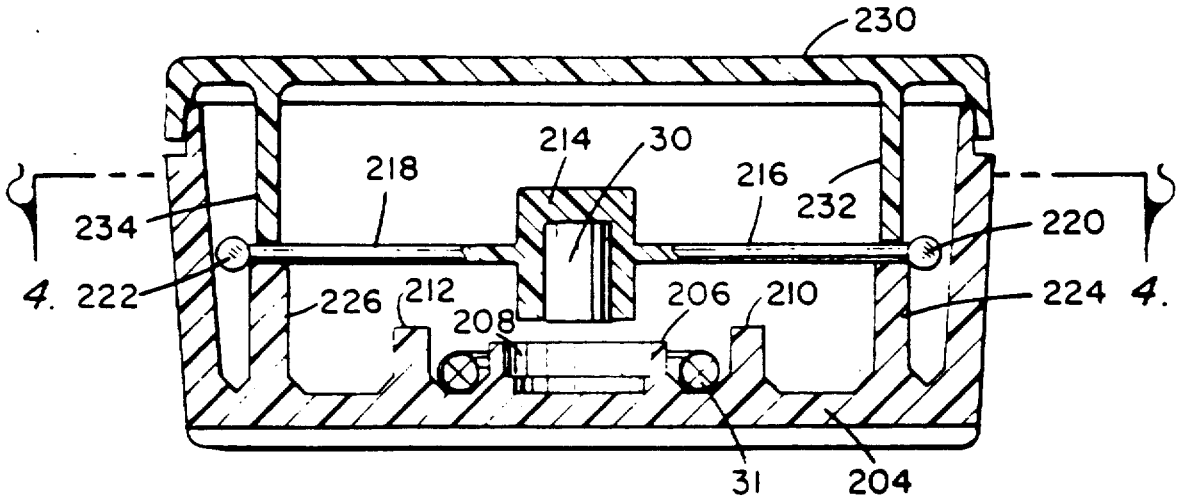

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–14 and 20–22 is confirmed.

Claim 15 is determined to be patentable as amended.

Claims 16–19, dependent on an amended claim, are determined to be patentable.

15. In a security system *as defined by claim 1 wherein said motion sensor provides:*

[sensing means for providing] a motion signal in response to motion imparted to [an element of the sensing means] *said motion sensor;* a signal processing means responsive to said motion signal for providing an output signal;

said signal processing means comprising first, second and third time delay circuits the first time delay circuit being connected to delay operation of the second and third time delay circuits and the second time delay circuit being connected to delay provision of said output signal following receipt by said signal processing means of a motion signal for a period determined only by said second time delay circuit;

said third time delay circuit being connected to continue furnishing of said output signal following termination of the motion signal for a period determined, after completion of the operation of said third time delay circuit, only by said third time delay circuit.

* * * * *

US004584569B1

REEXAMINATION CERTIFICATE (3818th)

United States Patent [19] [11] B1 4,584,569

Lopez et al. [45] Certificate Issued Jul. 27, 1999

[54] MOTION SENSITIVE SECURITY SYSTEM

[75] Inventors: Michael J. Lopez, Anaheim; Howard A. Williams, Jr., Santa Ana; Henry J. Salvatori, Whittier, all of Calif.

[73] Assignee: Directed Electronics, Inc., Vista, Calif.

Reexamination Request:
No. 90/004,842, Nov. 21, 1997

Reexamination Certificate for:

| | |
|---|---|
| Patent No.: | **4,584,569** |
| Issued: | **Apr. 22, 1986** |
| Appl. No.: | **06/650,835** |
| Filed: | **Sep. 17, 1984** |

Related U.S. Application Data

[63] Continuation-in-part of application No. 06/324,170, Nov. 23, 1981, abandoned.

[51] Int. Cl.[6] ..... G08B 21/00

[52] U.S. Cl. ..... 340/566; 73/650; 73/654; 340/429; 340/571

[58] Field of Search ..... 340/527, 528, 340/529, 530, 566, 429

[56] References Cited

U.S. PATENT DOCUMENTS

| | | | |
|---|---|---|---|
| 2,659,065 | 11/1953 | Cordell | 340/690 |
| 4,162,479 | 7/1979 | Nickell et al. | 340/528 |
| 4,335,376 | 6/1982 | Marquardt | 340/528 |

FOREIGN PATENT DOCUMENTS

| | | |
|---|---|---|
| 2281609 | 3/1976 | France . |
| 1128733 | 10/1968 | United Kingdom . |

OTHER PUBLICATIONS

Kurrelmeyer B. and Mais, W. H., Electricity and Magnetism, D. Van Nordstand Co., Inc., 1967.

Richter, C. F., Elementary Seismology, W. H. Freedman and Company, 1968.

Gurvich, I., Seismic Prospectin, MIR Publishers, 1972.

Plonsey, R. and Collin, R. E., Priciples and Applications of Electromagnetic Fields, McGraw-Hill Book Co., Inc., 1961.

*Primary Examiner*—Glen R. Swann, III

[57] ABSTRACT

The preferred arrangement utilizes a magnet suspended at the center of an elastic cord over a pickup coil. Movement of the magnet is sensed by the coil in that signals are generated by such movement. The signals are processed in the combination of a time delay circuit and a comparator to provide an output which is a measure of acceleration of the element on which the elastic cord is mounted and, in one form, by a measure of jerk in a similar time delay circuit and comparator combination.

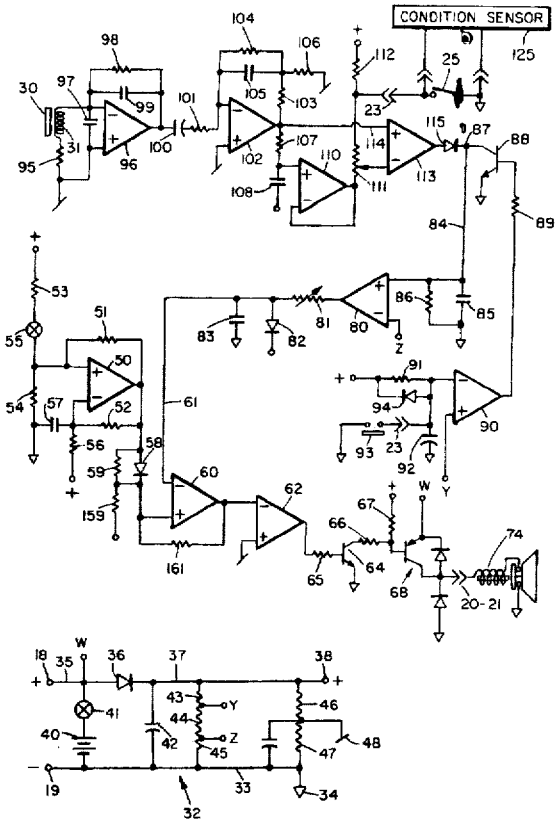

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–22 is confirmed.

* * * * *